United States Patent [19]

Halperin

[11] 4,439,941

[45] Apr. 3, 1984

[54] CARD WITH REMOVABLE AND REUSABLE INSERT

[75] Inventor: Edward Halperin, Allentown, Pa.

[73] Assignee: Greet 'N Wear, Inc., Virginville, Pa.

[21] Appl. No.: 381,475

[22] Filed: May 24, 1982

[51] Int. Cl.[3] ..... G09F 1/00

[52] U.S. Cl. ..... 40/124.1; 49/158; 46/35

[58] Field of Search ..... 40/160, 158, 124.1; 46/35; 40/124.1, 158 R

[56] References Cited

U.S. PATENT DOCUMENTS

| | | | |
|---|---|---|---|
| 624,347 | 5/1899 | Levy | 46/35 |
| 3,307,281 | 3/1967 | Mateo | 40/124.1 |
| 4,200,222 | 4/1980 | Feuer | 40/158 R |

FOREIGN PATENT DOCUMENTS

| | | | |
|---|---|---|---|
| 1473265 | 2/1967 | France | 40/160 |
| 2065568 | 7/1981 | United Kingdom | 434/83 |

*Primary Examiner*—Gene Mancene
*Assistant Examiner*—Wenceslao J. Contreras
*Attorney, Agent, or Firm*—Michael F. Petock

[57] ABSTRACT

A printed card, tag or the like with a reuseable printed multicolored emblem forming a part thereof is provided. The card, tag or the like is provided with a sheet member which forms at least a part of the card, tag or the like. A face of the sheet member is printed with a design. The printed face is provided with a reduced adhesive bonding ability surface, which may be provided by a silicone coating. A multicolored embroidered emblem is releasable attached to the face of the sheet. The design of the multicolored embroidered emblem forms an integral part of the pattern printed on the face. The multicolored embroidered emblem is constructed of embroidery threads of a single color to form a pattern having a sculptured effect on the face thereof created at least in part by varying the direction and number of thread stitches in various locations of the embroidered emblem. The multicolor pattern is printed on the embroidered emblem with different colors of the pattern being in registry with selected portions of the sculptured pattern. A layer of thermoplastic adhesive is provided on the back side of the embroidered emblem. In practice, a sheet member with the multicolored embroidered emblem thereon may be transferred to a recipient, such as in the form of a greeting card or a tag on a toy, and the recipient may remove the multicolored embroidered emblem and apply it to an article of clothing or the like by means of the layer of thermoplastic adhesive by the application of heat and/or pressure.

6 Claims, 5 Drawing Figures

FIG. 3
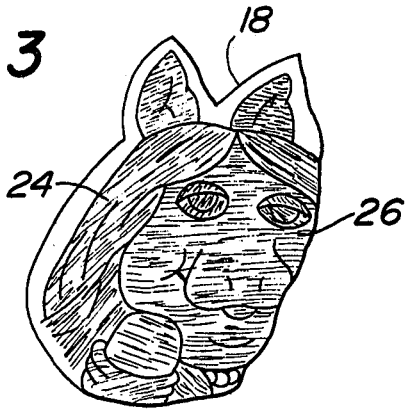
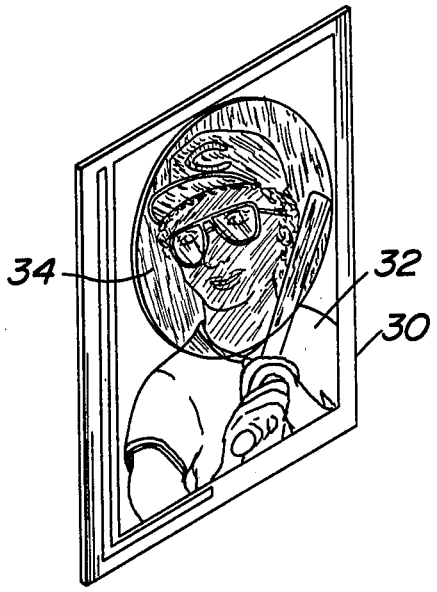
FIG. 4
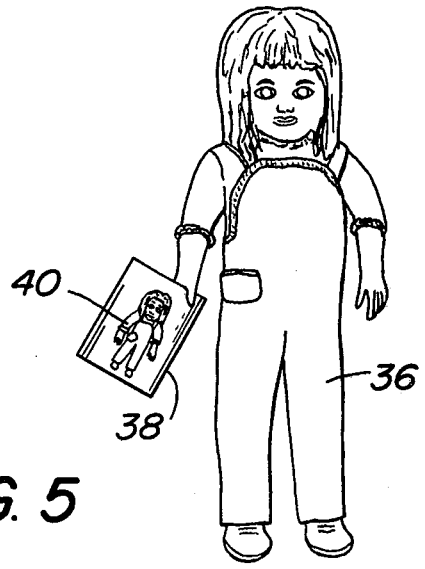
FIG. 5

CARD WITH REMOVABLE AND REUSABLE INSERT

BACKGROUND OF THE INVENTION

The present invention relates to a printed card, tag or the like with a reusable printed multicolored emblem forming a part thereof. More particularly, the present invention relates to a printed multicolored emblem which forms an integral part of the pattern or display on the card or tag, and which may be removed by the recipient of the card or tag to be applied to an article of clothing or the like without destroying the design of the card or tag.

Mailable greeting cards with a removable decal have been known in the past. For example, U.S. Pat. No. 4,200,222 discloses a greeting card with a removable decal secured to one side by adhesive. The card is provided with a foldable side having an opening which has the general outline of the decal, but of smaller perimeter, allowing viewing of the decal on the card as folded closed.

Similar such structures have been known in the past. For example, US. Pat. No. 2,363,472 discloses a mailing card having a removable decal. U.S. Pat. No. 2,547,359 discloses a combination greeting card and framed picture. U.S. Pat. No. 3,713,238 discloses a postcard including a photograph mounting means. A multicolored embroidered emblem made by sublistatic printing in registry with a white sculptured embroidered emblem is commercially available from Gilardone Mfg., Inc. or J. C. Gilardone & Son, Inc., both of Virginville, Pa., 19564.

However, it has not been known in the prior art to produce a high quality design, at least a portion of which is comprised of a printed multicolored reusable emblem which is constructed of a sculptured pattern of embroidery of a single color, preferably white, wherein the embroidered emblem forms a part of the overall design, and is removable therefrom for application to the clothing of a recipient while not destroying the design on the card or tag.

SUMMARY OF THE INVENTION

The present invnetion is a new and unobvious printed card, tag or the like with a reusable printed multicolored emblem forming a part thereof.

Briefly and basically, the card, tag or the like is comprised of a sheet member forming at least a part of the card, tag or the like. A face of the sheet member is provided with printing thereon. The face of the sheet member is provided with a reduced adhesive bonding surface, which may be provided by a silicone coating. A multicolored embroidered emblem is releasable attached to a face of the sheet member and forms an integral part of the pattern printed on the face. The multicolored embroidered emblem is constructed of embroidery threads of a single color, preferably white, to form a pattern having a sculptured effect on the face thereof created at least in part by varying the direction and number of thread stitches in various locations of the embroidered emblem. The multicolor pattern printed on the face of the emblem is printed in registry with the sculptured portions of the embroidered emblem so that different colors are in registry with selected sculptured portions. The embroidered emblem is provided with a thermoplastic adhesive on the backside of the embroidered emblem.

In use, a recipient of the card, tag or the like, such as the recipient of a greeting card, baseball card or toy, may remove the embroidered emblem and apply the embroidered emblem to an article of clothing or the like by means of the layer of thermoplastic adhesive by application of heat and/or pressure.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 3 is an exploded view of a broken out portion of the reusable printed multicolored emblem.

FIG. 4 is a view in perspective of a card in the form of a baseball card containing a reusable printed multicolored emblem forming a part thereof.

FIG. 5 is a view in perspective of a toy having a tag or the like with a reusable printed multicolored emblem forming a part thereof.

DETAILED DESCRIPTION OF THE PREFERRED EMBODIMENT

Figure 1:
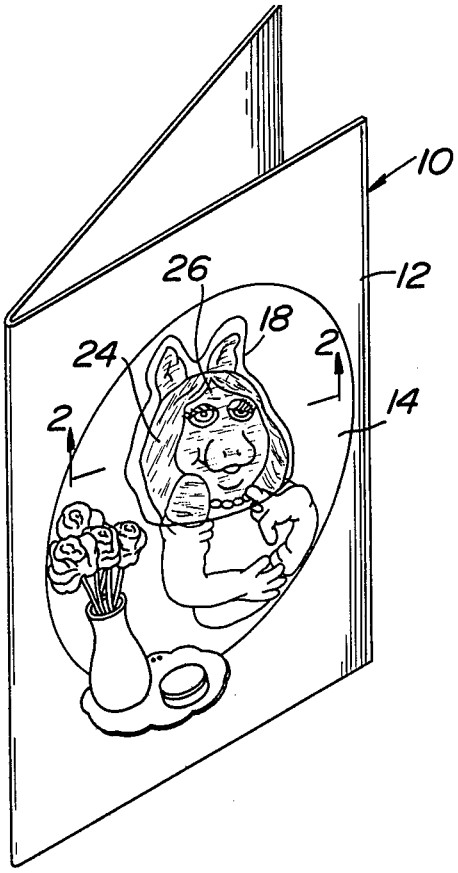
FIG. 1 is a view in perspective of a printed card with a reusable printed multicolored emblem forming a part thereof.

Referring now to the drawings in detail wherein like numerals indicate like elements, there is shown in FIG. 1 a greeting card 10. The greeting card 10 is comprised of a sheet member 12 in which at least a portion thereof is printed at 14.

Figure 2:
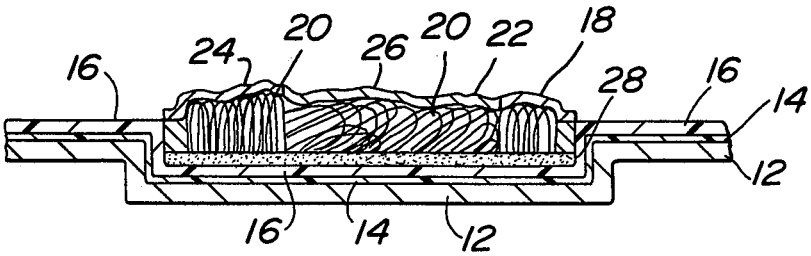
FIG. 2 is a view in cross section taken along lines 2—2 of FIG. 1.

Reference may be had simultaneously to FIGS. 1 & 2 for a better understanding of the invention. FIG. 2 is a cross section taken along line 2—2 of FIG. 1. However, FIG. 2 is not to scale and is of an expanded dimension, especially in the cross sectional dimensions, in order to illustrate the layers of the present invention. The printing 14 is illustrated as a layer on sheet member 12 in FIG. 2. The printing 14 is on the front or face of sheet member 12. Sheet member 12 is provided with a reduced adhesive bonding surface on the face of sheet member 12 which contains the printing 14. This reduced adhesive bonding surface may preferably be provided by a silicone layer 16. However, other methods of producing a reduced adhesive bonding surface on the face of sheet member 12 may be utilized.

A multicolored embroidered emblem 18 is releasably attached to the face of sheet nember 12 on top of the reduced adhesive bonding surface 16. The multicolored embroidered emblem 18 forms an integral part of the pattern printed on the face of card 10.

The multicolored embroidered emblem 18 may be best understood by reference simultaneously to FIGS. 1, 2 and 3. FIG. 3 is an enlarged broken out portion of multicolored embroidered emblem 18 shown in FIG. 1 which more clearly illustrates the varying directions of embroidery thread stitches.

The multicolored embroidered emblem 18 is constructed of embroidery threads 20 of a single color, preferably white, to form a sculptured pattern on the face thereof. The sculptured pattern is created at least in part by varying the direction of the stitches of the embroidery thread and the number of thread stitches in various locations of the embroidered emblem. The multicolored pattern is printed on the face thereof with at least two colors of dyestuff by a sublimation printing process wherein the dyestuff is transferred in a vapor state under heat and pressure or vacuum. The dyestuff which forms the printing on the embroidery threads is shown in FIG. 2 as layer 22. The multicolored pattern printed on the face of the embroidery is printed in registry with the sculptured embroidery on the embroidered emblem wherein selected colors are printed on selected sculptured portions of the sculptured embroidery. For example, the embroidery corresponding to the hair at 24 is provided with thread stitches running in the direction that hair would be expected to run and is printed with a blonde or yellowish color. The face would have embroidery stitches 26 running in a different direction, with different portions of the face having varying directions as needed, and is printed with a flesh color.

The backside of the multicolored embroidered emblem 18 is provided with a layer 28 of thermoplastic adhesive. The embroidered emblem 18 might be adhered to the silicone layer 16 by minimal heat or pressure applied to the embroidered emblem. Alternatively, an additional layer of adhesive may be utilized solely for the purpose of lightly adhering the embroidered emblem 18 to the face of card 10.

In use, the greeting card 10 may be mailed to a recipient. The recipient may remove the embroidered emblem and apply the embroidered emblem to an article of clothing or the like by means of the layer of thermoplastic adhesive by the application of heat and/or pressure. The removal of multicolored emblem 18 does not destroy the card 10 as the pattern contained on the multicolored embroidered emblem may also be printed on face of sheet member 12 at the location where embroidered emblem 18 is attached. As may be shown in FIG. 2, sheet member 12 may be impressed or indented by means of an engraving or dye press in order to produce a more uniform surface on the face of the card wherein the face of the releasable or removable embroidered emblem 18 is more nearly in line with the face of card 10.

Referring to FIG. 4, there is shown a card 30 which is commonly referred to in the marketplace as a baseball card. Card 30 is provided with a composite design 32 of a baseball player, usually a famous baseball player. A portion of the baseball card 34 is comprised of a multicolored embroidered emblem constructed in a manner as previously described with respect to multicolored embroidered emblem 18. Multicolored embroidered emblem 34 is releasable or removably attached to card 30 in a manner similar to emblem 18.

Referring to FIG. 5, there is shown a toy doll 36 having a hang tag 38 attached thereto. Hang tag 38 is provided with a multicolored embroidered emblem 40 which is releasable attached to the hang tag card 38 as previously described with respect to multicolored embroidered emblem 18. Multicolored embroidered emblem 40 may be a miniature reproduction of the doll 36 which may be removed and applied to the clothing of the recipient of the doll. Alternatively, multicolored embroidered emblem 40 may be in the design of another feature of the doll or other toy which identifies with the particular toy.

The present invention may be embodied in other specific forms without departing from the spirit or essential attributes thereof and, accordingly, reference should be made to the appended claims, rather than to the foregoing specification as indicating the scope of the invention.

I claim:

1. A card, tag or the like, comprising:

a sheet member forming at least a part of said card, tag or the like;

a face of said sheet member having a pattern printed thereon;

a reduced adhesive bonding surface on said face of said sheet member;

a multicolored embroidered emblem releasably attached to said face with said multicolored embroidered emblem forming an integral part of the pattern printed on said face;

said face of said sheet member being provided with printing of the same pattern as contained on the multicolored embroidered emblem on the face of said sheet member at the location where said embroidered emblem is releasably attached to said face;

said multicolored embroidered emblem being constructed of embroidery threads of a single color to form a sculptured pattern on the face thereof created at least in part by varying the direction and number of embroidery thread stitches in various locations of the embroidered emblem, and said multicolored pattern being printed on the face thereof with at least two colors of dyestuff, said printing thereon being in registry with the sculptured pattern of said embroidered emblem wherein selected colors are printed on selected sculptured portions of the sculptured embroidery, and a layer of thermoplastic adhesive being provided on the backside of said embroidered emblem; and whereby said sheet member may be transferred to a recipient, and whereby the recipient may remove said embroidered emblem and apply said emblem to an article of clothing or the like by means of a layer of thermoplastic adhesive by application of heat and pressure.

2. A card, tag or the like in accordance with claim 1 wherein said reduced adhesive bonding surface on said face of said sheet member is provided by a layer of silicone.

3. A card, tag or the like in accordance with claim 1 wherein said sheet member is provided with a depression or recess in the area where said multicolored embroidery emblem is releasably attached thereto.

4. An article in accordance with claim 1 wherein said sheet member forms a greeting card.

5. An article in accordance with claim 1 wherein said sheet member comprises a baseball card.

6. An article in accordance with claim 1 wherein said sheet member comprises a tag attachable to a toy or similar item.

* * * * *